US011060831B1

(12) United States Patent
Ervin et al.

(10) Patent No.: US 11,060,831 B1
(45) Date of Patent: Jul. 13, 2021

(54) SYSTEM AND METHOD FOR ROUTING FLAME WITHIN AN EXPLOSIVE DEVICE

(71) Applicant: U.S. Army Combat Capabilities Development Command, Army Research Labortary, Adelphi, MD (US)

(72) Inventors: Matthew H. Ervin, Clarksville, MD (US); David M. Lunking, Columbia, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/931,886

(22) Filed: May 14, 2020

(51) Int. Cl.
*F42C 19/08* (2006.01)

(52) U.S. Cl.
CPC ..... *F42C 19/0807* (2013.01)

(58) Field of Classification Search
CPC ..... F42C 19/0807; F42C 19/0834; F42C 19/0842; F42C 19/0846; C06C 5/06; F42D 1/04
See application file for complete search history.

(56) References Cited

U.S. PATENT DOCUMENTS 3,896,731 A * 7/1975 Kilmer ..... F42C 19/0846 102/305
4,475,461 A * 10/1984 Durrell ..... F42C 19/0846 102/200
4,612,264 A * 9/1986 Fairwood ..... H01M 6/38 429/114
5,192,829 A * 3/1993 Suire ..... F42B 5/045 102/204
5,325,785 A * 7/1994 Gardner ..... F42C 19/0834 102/430
6,659,009 B1 * 12/2003 Jordan ..... F42B 3/04 102/202
6,691,621 B2 * 2/2004 Pierrot ..... F42B 5/16 102/202.14
6,703,580 B2 * 3/2004 Brunet ..... C06B 27/00 102/202.7
6,761,116 B2 * 7/2004 Daoud ..... C06C 7/00 102/202.14
8,402,892 B1 * 3/2013 Scheid ..... F42D 1/043 102/275.12
8,550,001 B2 * 10/2013 Rastegar ..... F42C 15/24 102/216
8,869,700 B2 * 10/2014 Rastegar ..... F42C 11/008 102/216
9,252,433 B2 * 2/2016 Rastegar ..... H01M 6/5038

FOREIGN PATENT DOCUMENTS

CA 2161080 A1 * 5/1996 ..... F42C 19/0807
DE 1132471 B * 6/1962 ..... F42C 19/0807

* cited by examiner

*Primary Examiner* — Joshua T Semick
(74) *Attorney, Agent, or Firm* — Alan I. Kalb

(57) ABSTRACT

Various embodiments are directed to systems, apparatus and methods for guiding flame within a device such as a thermal battery, wherein a first energetic produces a flame that is guided toward each of a plurality of secondary energetics via respective paths within the device.

2 Claims, 4 Drawing Sheets

SYSTEM AND METHOD FOR ROUTING FLAME WITHIN AN EXPLOSIVE DEVICE

GOVERNMENT INTEREST

The invention described herein may be manufactured and used by or for the Government of the United States for all governmental purposes without the payment of any royalty.

FIELD OF THE DISCLOSURE

The present disclosure relates generally to explosive devices, more particularly, to flame guide devices and methods wherein flame from one primary energetic is routed to one or more secondary energetics or different portions of a secondary energetic.

BACKGROUND

This section is intended to introduce the reader to various aspects of art, which may be related to various aspects of the present invention that are described and/or claimed below. This discussion is believed to be helpful in providing the reader with background information to facilitate a better understanding of the various aspects of the present invention. Accordingly, it should be understood that these statements are to be read in this light, and not as admissions of prior art.

Industries using energetic materials, such as mining and pyrotechnics, utilize secondary explosive devices triggered by primary explosive devices. It is desirable to reduce the amount of primary explosive necessary to achieve a particular outcome to reduce cost and/or size of a device. Reducing the number of primary energetic devices, as well as the amount of primary energetic material, can also improve the safety of the overall device or operation by minimizing the handling of otherwise sensitive energetic materials.

SUMMARY OF THE INVENTION

Various deficiencies in the prior art are addressed below by the disclosed systems, methods and apparatus configured for guiding flame within a device such as a thermal battery, wherein a first energetic produces a flame that is guided toward each of a plurality of secondary energetics via respective paths within the device.

An apparatus according to one embodiment comprises a primary coupling portion configured for attachment to a primary energetic material and for receiving flame from the primary energetic material via an intake aperture; a body, having a hollow body portion defined therein and configured for directing flame from the intake aperture toward each of a plurality of flame channels defined within the body, wherein each flame channel is configured for directing flame toward a respective output aperture; and a plurality of secondary coupling portions, each secondary coupling portion configured for attachment to a respective secondary energetic material, or a respective site on a secondary energetic material, and for providing flame to the secondary energetic material via a respective output aperture.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

Figure 1:
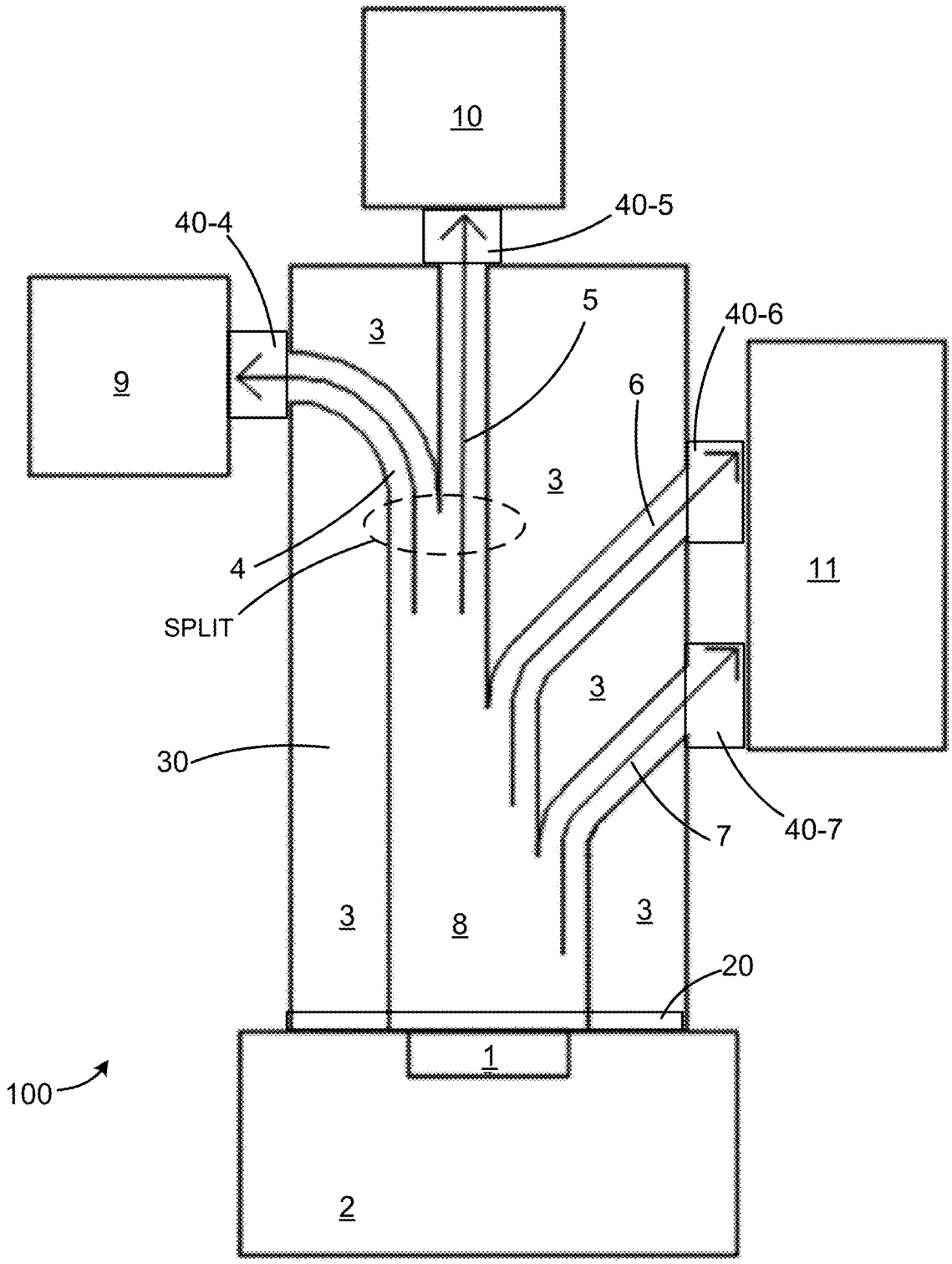
FIG. 1 depicts a cross-sectional view of an apparatus according to an embodiment.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

The following description and drawings merely illustrate the principles of the invention. It will thus be appreciated that those skilled in the art will be able to devise various arrangements that, although not explicitly described or shown herein, embody the principles of the invention and are included within its scope. Furthermore, all examples recited herein are principally intended expressly to be only for illustrative purposes to aid the reader in understanding the principles of the invention and the concepts contributed by the inventor(s) to furthering the art and are to be construed as being without limitation to such specifically recited examples and conditions. Additionally, the term, "or," as used herein, refers to a non-exclusive or, unless otherwise indicated (e.g., "or else" or "or in the alternative"). Also, the various embodiments described herein are not necessarily mutually exclusive, as some embodiments can be combined with one or more other embodiments to form new embodiments.

The numerous innovative teachings of the present application will be described with particular reference to the presently preferred exemplary embodiments. However, it should be understood that this class of embodiments provides only a few examples of the many advantageous uses of the innovative teachings herein. In general, statements made in the specification of the present application do not necessarily limit any of the various claimed inventions. Moreover, some statements may apply to some inventive features but not to others. Those skilled in the art and informed by the teachings herein will realize that the invention is also applicable to various other technical areas or embodiments (e.g., explosive fracking and the like).

Various embodiments comprise a flame guide, flame routing or flame directing device that constrains and directs flame from a small primary energetic (explosive) device to deliver the resulting flame, some portions of the flame, or one or more hot particles to multiple/remote locations. In this manner, a small primary energetic device may be used to ignite one or more secondary charges at various locations, or a single secondary charge at multiple places, or some combination thereof. Advantageously, various embodiments reduce the amount of primary energetic needed to ignite various secondary charges or to control the burn properties of a secondary charge through multiple ignition points. That is, the flame guide may be used to direct flame (or portions thereof) in arbitrary directions which may reduce the number or size of primary devices required to trigger a larger or more complex device (e.g., multiple secondary energetics) and/or improve the synchronization of secondary burn events.

In particular, rather than allowing flame from a primary explosive device to expand in all directions in an indiscriminate manner, flame directing apparatus according to the embodiments directs this expanding flame (flame front) via one or more tubes or channels formed within the body of the apparatus. The tubes/channels are configured to constrain the expansion of this flame and direct portions of this flame to respective locations of secondary charges (or other targets) where the flame is desired to ignite secondary charges or perform a flame-related function at other types of targets. Guiding the flame in this way allows secondary charges at further distances to be ignited, multipoint ignition to tune the burning of the secondary charge(s) and other functions Various embodiments are directed to a flame guide generated using 3D printing techniques. Other manufacturing methods are suitable for fabrication of a flame guide, such as welding and/or bending of small tubes; however, 3D printing is a simple method of achieving complex flame paths. Various embodiments are directed to flame guides capable of changing the direction of travel of flame passing therethrough by more than 90 degrees, to split the flame delivering portions to different locations, and/or to ignite secondary energetics at these locations.

FIG. 1 depicts a cross-sectional view of an apparatus according to an embodiment. The flame guide apparatus 100 is configured to route flame from a primer charge 1 toward each of a plurality of secondary charges 9-11. The flame guide apparatus 100 of FIG. 1 is shown in cross-section view to illustrate an embodiment in which various internal portions 3 forming a body of the flame guide apparatus 100 are shaped to define thereby an initial hollow body portion 8 and several (illustratively four) flame channels 4-6.

The flame guide apparatus 100 depicted in FIG. 1 comprises a thermoplastic device formed using a 3D printer and generally comprising an elongated body having a proximal end denoted as a primary coupling portion, and a distal end. The depicted flame guide apparatus 100 generally comprises a primary coupling portion 20, a body portion 30, and a plurality of secondary coupling portions 40.

The primary coupling portion 20 is configured for attachment to a primary explosive 1 and for receiving flame from the primary explosive 1 via an intake aperture, illustratively an opening in the flame guide apparatus body associated with the hollow body portion 8. In the depicted embodiment, the flame guide apparatus 100 is pressed against (compression fit) or otherwise secured to a substrate/packaging 2 of a primary explosive 1 such that a flame (not shown) emitted by the primary explosive 1 is contained and directed into the hollow body 8. In this embodiment, the primary explosive 1 is an energetic nanoporous silicon device 2.5 mm in diameter that is activated with sodium perchlorate, while the hollow body is a branching tube 2.75 mm in diameter.

The body 30 includes a hollow body portion 8 defined therein which is configured for directing flame from the intake aperture (e.g., the opening of the hollow body portion facing the primary explosive 1) toward each of a plurality of flame channels defined within the body (illustratively four flame channels denoted as flame channels 4-7), wherein each flame channel is configured for directing flame toward a respective output aperture of a secondary coupling portion 40 (e.g., the opening of the flame channel facing the respective secondary explosive or portion thereof). The longest length of the hollow body 8, as measured from the primary energetic 1 to the secondary coupling portion 40-5, can be of any length such that the resulting volume of flame guide is selected to control the pressure of the gas/flame output by the amount and composition of primary energetic material selected; illustratively, in one example, 53 mm, or 20 times the diameter of the primary energetic material.

Each secondary coupling portion 40 is configured for attachment to a respective secondary explosive or portion thereof, and for providing flame to the secondary explosive via a respective output aperture. As depicted in FIG. 1, the flame guide apparatus 100 comprises four flame channels that direct the flame from the primary energetic along four distinct paths 4, 5, 6 and 7, thereby directing flame toward four respective secondary couplings 40-4, 40-5, 40-6 and 40-7. Each of these secondary couplings would open onto, or connect to, a secondary energetic material that will be initiated by the directed flame.

As depicted in FIG. 1, the flame guide apparatus 100 is pressed against (compression fit) a substrate/packaging (2) of a primary explosive (1), such that the flame (not shown) emitted by the primary explosive (1) is contained and directed into the hollow body (8) of the flame guide (30). The flame is then split between a number of branches, represented by arrows in FIG. 1., in the flame guide such that portions of the flame travel the paths described by the flame channels (4-7). The individual portions of the flame are then directed to multiple secondary charges (9-11) or multiple points on a secondary charge, such as shown with respect to flame guides 6 and 7 impinging on the same secondary charge (11).

The primer or starting material 1 may be comprised of any suitable energetic that produces hot gas and/or hot particles, such as energetic porous silicon, thermites such as Al/CuO, primary explosives such as lead azide, flammable fibrous materials such as nitrocellulose, gun cotton, flash paper and so on. The primer or starting material is not limited to being a solid, so a flammable liquid hydrocarbon such as methanol, or a flammable gas such as methane (e.g., when mixed with an oxidizer such as air) may also be used for this purpose.

The secondary or receiving material (9, 10, 11) may comprise any suitable energetic sensitive to hot gas and/or hot particles, such as those listed above with respect to the primer or starting material.

The material for constructing the flame channels may be formed by, illustratively, 3D printing such as by using a low thermal conductivity plastic (so as to avoid absorbing significant amounts of heat from the transmitted gas.) Suitable materials include, illustratively, thermoplastics appropriate for fused filament fabrication (e.g., ABS, polypropylene, PLA, PETG, polyamide/nylon and the like), thermoset resins appropriate for stereolithographic printing (e.g., photoresists, photo resins, photo-initiated epoxies and the like), low thermal conductivity ceramics (e.g., $ZrO_2$ and similar) as well as other materials having properties consistent with the relevant functions defined herein.

Advantageously, the various embodiments of the disclosed flame guide apparatus enable the confining, splitting, and/or redirecting of primary explosive flame such that it may be used to ignite multiple charges at various remote locations from the primary explosive. Further, various embodiments of the disclosed flame guide apparatus are reconfigurable in order to tune the burn properties of the secondary(s) as well as enabling new safe and arm mechanisms.

Various embodiments contemplate a device or apparatus including, illustratively, a primary coupling portion configured for attachment to a primary energetic material and for receiving flame from the primary energetic material via an intake aperture; a body, having a hollow body portion defined therein and configured for directing flame from the intake aperture toward each of a plurality of flame channels defined within the body, wherein each flame channel is configured for directing flame toward a respective output aperture; and a plurality of secondary coupling portions, each secondary coupling portion configured for attachment to a respective secondary energetic material, or a respective site on a secondary energetic material, and for providing flame to the secondary energetic material via a respective output aperture.

In various embodiments, the primary coupling portion may be configured for attachment to a substrate including a primary energetic material, such as via any of a threaded coupler, a compression fit, an adhesive, a solder, a braze, a weld and the like. The various secondary coupling portions may configured for attachment to secondary energetic materials via any of a threaded coupler, a compression fit, an adhesive, a solder, a braze, a weld and the like.

In various embodiments, a substrate may be attached to the primary coupling portion and include a primary energetic material device aligned with the intake aperture of the primary coupling portion, such that a plurality of secondary energetic materials may be attached to respective secondary coupling portions and aligned with respective output apertures thereof.

In various embodiments, the intake aperture forms an initial portion of the hollow body portion and exhibits a cross-sectional area normal to a flame flow direction. It is noted that FIG. 1 depicts a device/apparatus wherein the hollow body portion exhibits a cross-sectional area having a substantially rectilinear shape/area that is, illustratively, at least twice the area of a cross-sectional area of a flame channel. However, the hollow body portion may be formed using different shapes such as circular, ovoid, square, and/or other shapes.

Generally speaking, the shapes/sizes of the cross-sectional areas of the hollow body portion and flame channels are selected to support flame passing therethrough without extinction. In various embodiments, such as where longer flame channels are required for some secondary energetics but not others, different flame channels may be configured with different shapes/sizes of cross-sectional areas to, in effect, "tune" the different flame channels for their intended functions (i.e., delivering flame to their respective secondary energetics). Further, in various embodiments the shapes/sizes of cross-sectional areas of any of the flame channels may be varied along the length of the flame channel. The path traced by a flame channel may be varied to change the direction of flame flow within the channel. Further, the direction of flame flow exiting a channel for delivery to the surface of an energetic may be normal to that surface (such as depicted in FIG. 1 with respect to channels 4 and 5 delivering flame at a flame flow approximately 90 degrees from surface normal of energetics 9 and 10 respectively) or at an angle to that surface (such as depicted in FIG. 1 with respect to channels 6 and 7 delivering flame at a flame flow approximately 45 degrees from surface normal of energetic 11; this may be adjusted from 0 degrees to 180 degrees). For example, in various embodiments the hollow body 30 is reconfigurable by rotating/translating a cylinder/slide formed therein, or by connecting different output apertures to the input aperture. That is, the depicted chambers may be reconfigured in terms of volume and/or direction by physical adjustment of the device such as in the field prior to use of the device.

In various embodiments, the time of flame travel through each of a plurality of flame channels is tuned to achieve a desired result, such as simultaneous ignition of a plurality of respective secondary energetics, simultaneous ignition of the plurality of respective secondary energetics, and/or some combination of simultaneous and sequential ignition of the plurality of respective secondary energetics.

In various embodiments, one or more of the flame channels may be divided to provide multiple sub-channels, such as depicted in FIG. 1 where flame channels 4 and 5 are formed by splitting an initial channel formed within the hollow body portion 8.

In various embodiments, two or more flame channels may be used to pass flame to two or more locations on a single secondary energetic material, such as depicted in FIG. 1 where flame channels 6 and 7 are configured to deliver flame to different locations of a secondary energetic 11.

Advantageously, the various embodiments enable (1) use of a smaller primary charge since the flame is confined so that it will reach secondary charges at a greater distance than without the invention; (2) an ability to split the flame into multiple flames so that multiple secondary charges may be ignited; (3) an ability to redirect the flame(s) so that there is significantly more flexibility in coupling the primary to the various secondary charges; (4) flame splitting and redirecting supporting uses such as multipoint initiation of a single secondary charge in order to modify its burn profile/properties; and (5) an ability to provide a flame guide that is modular in nature with respect to a larger system in that the flame guide may be swapped out of the larger system or reconfigured for use within the larger system so as to tune the burn properties of the explosive(s) of the larger system depending on mission needs (e.g., improve synchronization of secondary charges, or reconfigurable burn profiles for tunable shape charge behavior).

Figure 2B:
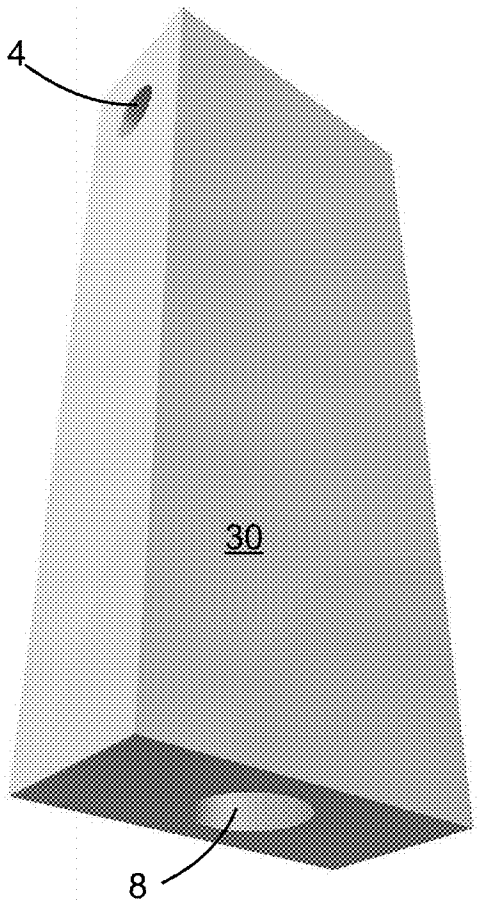
FIGS. 2A-2B depict respective top orthogonal and bottom orthogonal views of an embodiment of the apparatus of FIG. 1.
Figure 2A:
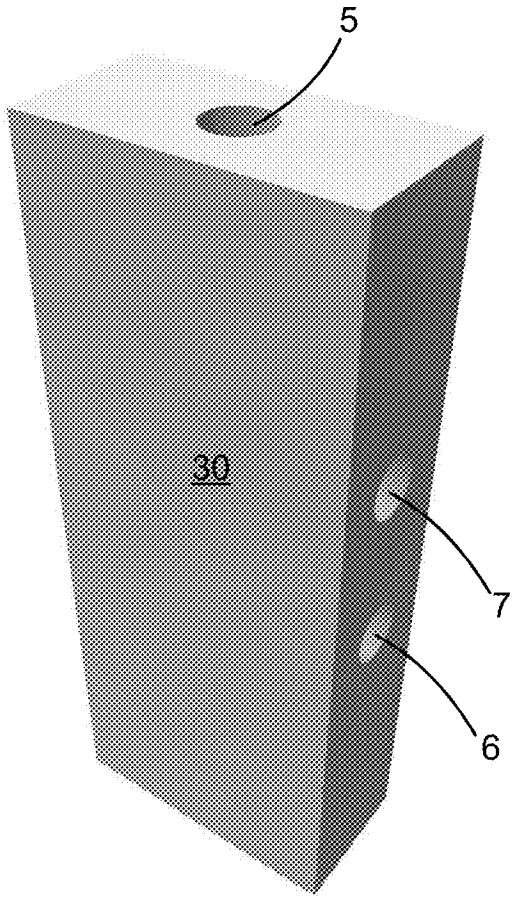

FIGS. 2A-2B depict respective top orthogonal and bottom orthogonal views of an embodiment of the apparatus of FIG. 1.

One embodiment comprises a thermal battery where the output (flame) of a small primary energetic is directed to ignite secondary energetic electrolyte at various locations along a large (relative to the unconstrained flame dimensions) thermal battery. Similar embodiments are useful where multipoint ignition of a secondary charge is required for tuning its burn properties, such as for controlling explosive yield or blast directionality from a munition. Such flame guides may also be interchangeable or reconfigurable to enable rapid reconfiguring of the burn properties. Generally speaking, various embodiments are configured to confine and redirect flame (hot gasses and/or hot particles) toward the secondary energetics in order to ignite multiple secondary charges at various locations and, optionally, at specified relative times or in a specified sequence.

Figure 3:
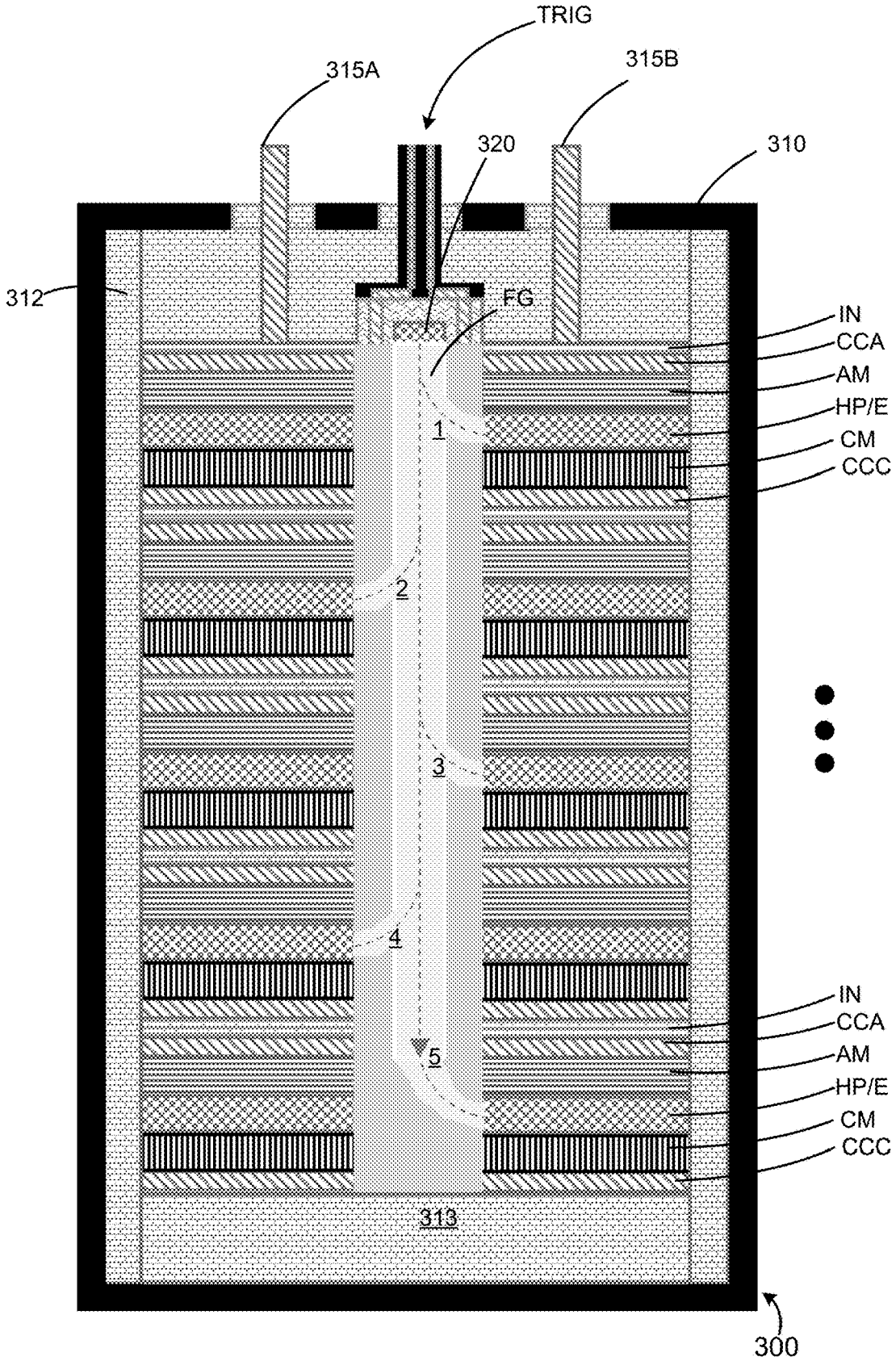
FIG. 3 depicts a cross-sectional view of a thermal battery according to an embodiment.

FIG. 3 depicts a cross-sectional view of a thermal battery according to an embodiment. Specifically, the thermal battery 300 of FIG. 3 comprises a casing 310 and thermal insulation 312 forming an elongated body (e.g., cylindrical or other shape) having an upper and lower portion, wherein disposed within the upper portion is a first energetic 320 operably connected to a triggering device TRIG (e.g., an electric triggering device). A flame guide FG is formed within the thermal battery 300 as an axially aligned region extending from the first energetic 320 toward a base portion 313 of the thermal battery 300. When the first energetic 320 is ignited by the triggering device TRIG, a flame front enters the flame guide FG and is directed along seven distinct paths 1-7, wherein each of the paths 1-7 is configured to direct flame to a respective secondary energetic denoted as a heat pellet/Electrolyte (HPE).

The thermal battery 300 comprises a thermal battery stack in which a plurality (illustratively seven) of repeating layers are disposed about a central, axially disposed flame guide FG; namely, an insulating layer IN, a current collector (anode) layer CCA, an anode material AM, a heat pellet/Electrolyte (HPE), a cathode material (CM) and a current collector cathode (CCC). As depicted in FIG. 3, each of the paths 1-5 directs flame to a respective heat pellet/Electrolyte (HPE) of a respective group of repeating layers forming the thermal battery stack.

When ignited, the electrolytes of the thermal battery 300 become molten and the resulting chemical reactions release electrical power that is delivered via the battery electrodes 315A an 315B.

In various embodiments, the thermal battery 300 (or other device) is configured such that a mechanical rotation or translation of part of the device results in a change to the flame guide FG such that more, fewer, or different flame paths are utilized. More generally, such a mechanical rotation or translation operates to change the device configuration after manufacture of the device (e.g., different power output levels, different fuse timing, etc.) and/or enable/disable safety features of the device. (e.g., blocking flame guide paths until a portion of device is rotated to enable proper alignment of such paths with the central or main flame guide).

Figure 4:
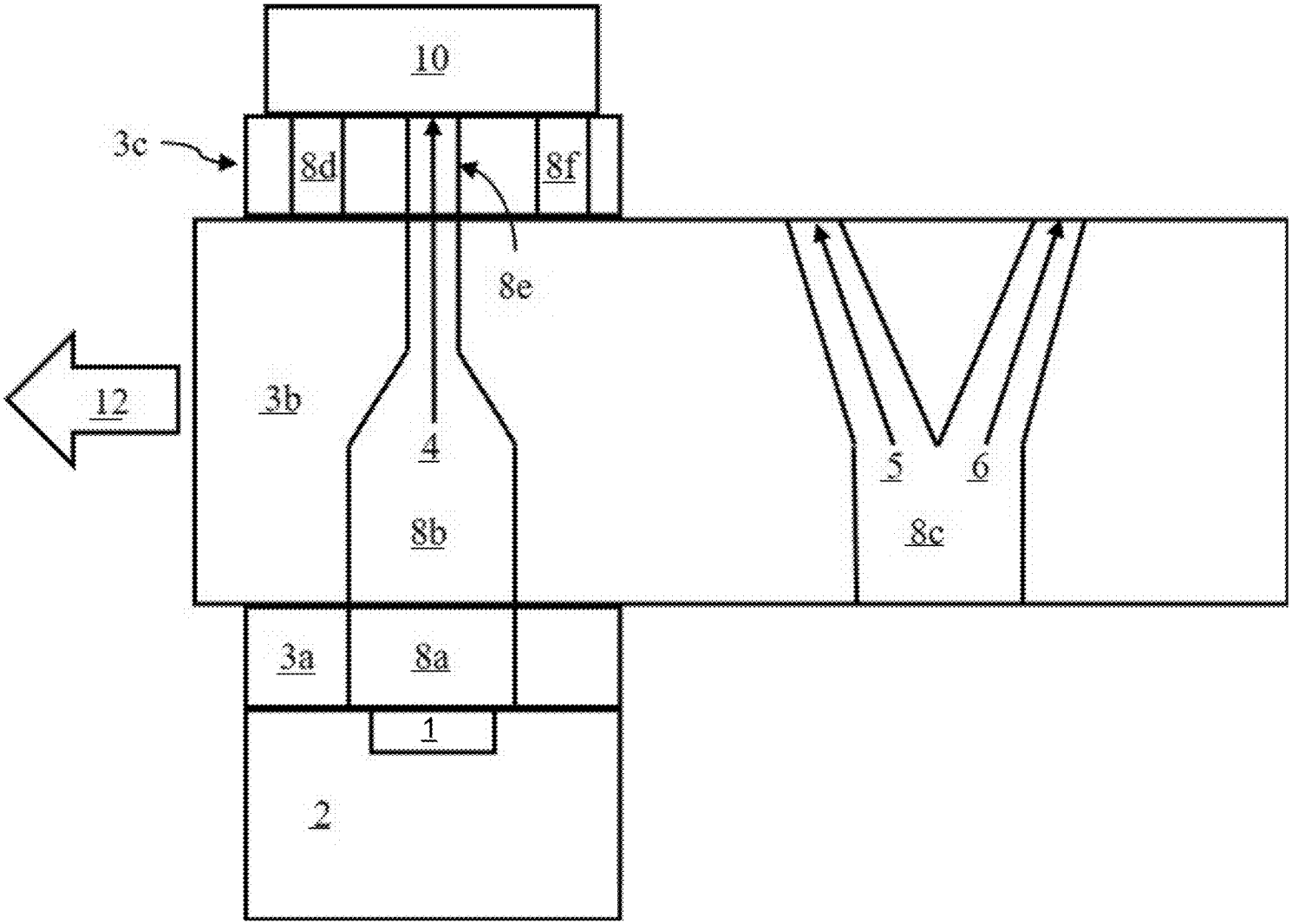
FIG. 4 depicts a cross-sectional view of a device including a reconfigurable flame guide.

FIG. 4 depicts a cross-sectional view of a device including a reconfigurable flame guide. Specifically, the device 400 includes a flame guide that is reconfigurable so as to allow a choice between initiations points on the secondary energetic(s). Other configurations yielding other choices are also contemplated.

Referring to FIG. 4, a flame guide body 3 comprises, illustratively, three sections denoted as 3*a*, 3*b* and 3*c*. Section 3*b* is a movable section (with respect to sections 3*a* and 3*c*), and has formed therein multiple (illustratively two) flame channels denoted as 8*b* and 8*c*, which flame channels may be aligned with differing flame channels within section 3*c*. As depicted, section 3*b* is positioned such that flame channel 8*b* within section 3*b* is aligned with a flame channel 8*e* within section 3*c* and a flame channel 8*a* within section 3*a*, to support thereby a flame path 4.

Section 3*b* is shown as being slideably engaged with sections 3*a* and 3*c* such that section 3*b* may be used to reconfigure the device flame guide from supporting flame path 4 to supporting flame paths 5 and 6. When configured as shown, the flame from a primary energetic 1 passes through the combined flame channels 8*a*, 8*b*, 8*e* as represented by the flame path arrow 4, to ignite the center of a secondary energetic 10.

Section 3*b* may be moved in accordance with direction 12 (i.e., left as shown) such that flame channel 8*c* of section 3*b* is aligned with flame channel 8*a* of section 3*a*. Further, such lateral translation of section 3*b* also aligns the split out portions of flame channel 8*c* of section 3*b* supporting flame paths 5 and 6 with, respectively, flame channels 8*d* and 8*f* of section 3*c*. When configured in this manner, the flame from the primary energetic 1 passes through the combined flame channels 8*a*, 8*c*, 8*d* and 8*a*, 8*c*, 8*f* as represented by the flame path arrows 5 and 6, to ignite both left edge and right edge portions of the secondary energetic 10. The dual edge ignition of the secondary energetic 10 in this configuration provides a different burn path than that described above with respect to the center ignition the secondary energetic 10, producing different burn characteristics. It is noted that while a single secondary energetic 10 has been depicted herein, various embodiments contemplate two or more separate secondary energetics with one each coupled to the flame channels (8*d-f*). For simplicity, the reconfigurable channels (i.e., section 3*b*) have been drawn as a linear slide. However, other embodiments contemplate a section that is rotatable with respect to other section wherein different flame channels may be rotated into place to support different types and/or numbers of ignitions.

Thus, the coupling portion 3*b* of the device 400 is configured for user manipulation via mechanical translation (e.g., sliding back and forth or rotating between two or more positions) to enable thereby a change to device configuration after manufacture in accordance with respective flame guide geometries provided at each position. In this manner, the device may have one or more reconfigurable flame paths to achieve various goals, such as increasing a time required to for flame to reach one or more secondary energetics (e.g., by increasing the length and/or volume of the relevant flame path) and directing a flame to a different part of a secondary energetic (e.g., by selecting one or more flame paths associated with that different part of the secondary energetic). Other variations are also contemplated by the inventors.

Specifically, each of the plurality of positions to which a movable portion of the device (e.g., coupling portion 3*b*) may be set is associated with a flame guide geometry operative for reconfiguring at least one flame path between the primary and secondary energetics such as by increasing or decreasing a time required for flame to reach one or more secondary energetics, increasing or decreasing a time required for flame to reach one or more locations on a secondary energetic, directing flame to a different portion of a secondary energetic and so on.

Various modifications may be made to the systems, methods, apparatus, mechanisms, techniques and portions thereof described herein with respect to the various figures, such modifications being contemplated as being within the scope of the invention. For example, while a specific order of steps or arrangement of functional elements is presented in the various embodiments described herein, various other orders/arrangements of steps or functional elements may be utilized within the context of the various embodiments. Further, while modifications to embodiments may be discussed individually, various embodiments may use multiple modifications contemporaneously or in sequence, compound modifications and the like.

Although various embodiments which incorporate the teachings of the present invention have been shown and described in detail herein, those skilled in the art can readily devise many other varied embodiments that still incorporate these teachings. Thus, while the foregoing is directed to various embodiments of the present invention, other and further embodiments of the invention may be devised without departing from the basic scope thereof. As such, the appropriate scope of the invention is to be determined according to the claims.

What is claimed is:

1. An apparatus, comprising:

a primary coupling portion configured for attachment to a primary energetic material and for receiving flame from the primary energetic material via an intake aperture;

a body, having a hollow body portion defined therein and configured for directing flame from the intake aperture toward each of a plurality of flame channels defined within the body, wherein each flame channel is configured for directing flame toward a respective output aperture; and a plurality of secondary coupling portions, each secondary coupling portion configured for attachment to a respective secondary energetic material, or a respective site on a secondary energetic material, and for providing flame to the secondary energetic material via a respective output aperture wherein the primary coupling portion is configured for attachment to a substrate including a primary energetic material wherein the primary coupling portion and substrate attach via any of a threaded coupler, a compression fit, an adhesive, a solder, a braze, or a weld wherein each of the secondary coupling portions are configured for attachment to secondary energetic materials via any of a threaded coupler, a compression fit, an adhesive, a solder, a braze, or a weld wherein the apparatus further comprises:

a substrate attached to the primary coupling portion and including a primary energetic material device aligned with the intake aperture of the primary coupling portion; and a plurality of secondary energetic materials attached to respective secondary coupling portions and aligned with respective output apertures thereof and wherein the apparatus comprises a thermal battery.

2. An apparatus, comprising:

a primary coupling portion configured for attachment to a primary energetic material and for receiving flame from the primary energetic material via an intake aperture;

a body, having a hollow body portion defined therein and configured for directing flame from the intake aperture toward each of a plurality of flame channels defined within the body, wherein each flame channel is configured for directing flame toward a respective output aperture; and a plurality of secondary coupling portions, each secondary coupling portion configured for attachment to a respective secondary energetic material, or a respective site on a secondary energetic material, and for providing flame to the secondary energetic material via a respective output aperture wherein the primary coupling portion is configured for attachment to a substrate including a primary energetic material wherein the primary coupling portion and substrate attach via any of a threaded coupler, a compression fit, an adhesive, a solder, a braze, or a weld wherein each of the secondary coupling portions are configured for attachment to secondary energetic materials via any of a threaded coupler, a compression fit, an adhesive, a solder, a braze, or a weld wherein the apparatus further comprises:

a substrate attached to the primary coupling portion and including a primary energetic material device aligned with the intake aperture of the primary coupling portion; and a plurality of secondary energetic materials attached to respective secondary coupling portions and aligned with respective output apertures thereof and wherein the apparatus comprises a thermal battery wherein the intake aperture forms an initial portion of the hollow body portion, wherein the hollow body portion exhibits a cross-sectional area normal to a flame flow direction that is at least twice the area of a cross-sectional area of a flame channel wherein the cross-sectional areas the hollow body portion and flame channels are sized to support flame passing therethrough without extinction, wherein the cross-sectional area of two or more flame channels are different sizes to support the flame passing therethrough without extinction for flame channels of different lengths.

* * * * *